US007841281B2

(12) United States Patent
Valentinsson

(10) Patent No.: US 7,841,281 B2
(45) Date of Patent: Nov. 30, 2010

(54) TRANSPORT PALLET

(75) Inventor: Anders Lenart Valentinsson, Färlöv (SE)

(73) Assignee: Schoeller Arca Systems Services GmbH, Pullach (DE)

( * ) Notice: Subject to any disclaimer, the term of this patent is extended or adjusted under 35 U.S.C. 154(b) by 279 days.

(21) Appl. No.: 11/818,751

(22) Filed: Jun. 15, 2007

(65) Prior Publication Data

US 2008/0143514 A1 Jun. 19, 2008

Related U.S. Application Data

(63) Continuation-in-part of application No. 11/641,240, filed on Dec. 19, 2006.

(51) Int. Cl.
*B65D 19/38* (2006.01)

(52) U.S. Cl. ..... 108/57.25

(58) Field of Classification Search ..... 108/57.25, 108/51.11, 56.1; 206/386; 248/346.02, 346.01
See application file for complete search history.

(56) References Cited

U.S. PATENT DOCUMENTS

| | | | | |
|---|---|---|---|---|
| 4,051,787 | A | 10/1977 | Nishitani et al. | |
| 5,042,396 | A * | 8/1991 | Shuert | 108/57.25 |
| 5,408,937 | A | 4/1995 | Knight, IV et al. | |
| 5,413,052 | A * | 5/1995 | Breezer et al. | 108/56.1 |
| 5,676,064 | A * | 10/1997 | Shuert | 108/57.25 |
| 5,868,080 | A * | 2/1999 | Wyler et al. | 108/57.25 |
| 5,924,589 | A * | 7/1999 | Gordon | 220/23.91 |
| 5,989,706 | A * | 11/1999 | McGinniss et al. | 428/341 |
| 6,237,509 | B1 * | 5/2001 | Ishido et al. | 108/57.25 |
| 6,622,642 | B2 * | 9/2003 | Ohanesian | 108/57.25 |
| 6,718,888 | B2 | 4/2004 | Muirhead | |
| 6,758,148 | B2 * | 7/2004 | Torrey et al. | 108/51.11 |
| 6,928,933 | B2 * | 8/2005 | Grau | 108/57.25 |
| 6,943,678 | B2 * | 9/2005 | Muirhead | 340/505 |
| 6,955,128 | B2 * | 10/2005 | Apps | 108/57.25 |
| 6,986,309 | B2 * | 1/2006 | Sugihara et al. | 108/57.25 |
| 7,216,592 | B2 | 5/2007 | Krech et al. | |
| 7,252,041 | B2 * | 8/2007 | Overholt et al. | 108/57.28 |
| 2004/0168618 | A1 * | 9/2004 | Muirhead | 108/57.25 |
| 2004/0261669 | A1 | 12/2004 | Apps | |
| 2006/0011108 | A1 * | 1/2006 | Abu-Isa et al. | 108/57.25 |
| 2006/0201399 | A1 * | 9/2006 | Swistak et al. | 108/57.25 |
| 2006/0201402 | A1 | 9/2006 | Moore, Jr. et al. | |
| 2006/0236903 | A1 * | 10/2006 | Moore, Jr. | 108/57.25 |
| 2007/0000415 | A1 | 1/2007 | Moore, Jr. | |
| 2008/0053342 | A1 * | 3/2008 | Muirhead | 108/57.25 |

* cited by examiner

*Primary Examiner*—José V Chen
(74) *Attorney, Agent, or Firm*—Van Dyker, Gardner, Linn & Burkhart, LLP

(57) ABSTRACT

A pallet for the movement of goods includes several individual parts connected to one another, including a loading part, which comprises a loading surface and a reinforcement section. The goods to be transported are placed on the loading surface of the loading part, and the reinforcement section is positioned below the loading part, along with a frame section, comprising a frame center section and a frame floor section. The pallet may be formed from a fire retardant material and may include a transponder for locating the pallet.

27 Claims, 11 Drawing Sheets

G
48
32

48
31

E-E
43
3

F
27
31
9
G
D-D
32

49
F

A-A
3
43

B-B
3
43
44

TRANSPORT PALLET

CROSS REFERENCE TO RELATED APPLICATIONS

The present application is a continuation-in-part of U.S. patent application Ser. No. 11/641,240, filed Dec. 19, 2006 by Valentinsson for TRANSPORT PALLET, which is hereby incorporated herein by reference in its entirety.

FIELD OF THE INVENTION

The present invention relates generally to a pallet for the movement of goods.

BACKGROUND OF THE INVENTION

For the transport of goods, transport pallets, especially Euro pallets, are well-known, which are traditionally made of wood. Furthermore, pallets manufactured from plastic are also common, which, in addition to having a low weight, have better resistance to aging and are better to clean in comparison to wood. Many well-known pallets, however, have a relatively low torsional rigidity. They therefore cannot be readily subjected to asymmetric heavy loads. This reduces the scope of application. Furthermore, the problem arises in the case of plastic pallets that the plastic is flammable such that, in the event of a fire, toxic gases can develop. This, too, leads to a fundamentally undesirable restriction on the pallet's scope of application.

The object of the present invention is to create a pallet whose scope of application is increased.

SUMMARY OF THE INVENTION

According to an aspect of the present invention, a transport pallet has an upper section and a frame section, wherein the upper section has a loading part with loading surface and a reinforcement section that have a material-fit connection to each other. The frame section comprises a frame center section and a frame floor section, which likewise have a material-fit connection to one another. Furthermore, the frame center section corresponds to the size of the loading surface and, at least at its corners, has spacers which point toward the upper section and via which the frame center section is connected to the upper section. At their end faces, the spacers have elevations which are inwardly offset in steps. For accommodating these elevations, the reinforcement section has recesses at its lower surface. The frame center section likewise has a material-fit connection to the reinforcement section in the area of the end-face spacers. Alternatively or additionally, the aforementioned connection can be in the area of the elevations. The pallet in accordance with the invention is substantially torsionally stiffer than well-known pallets, because the upper section and the frame section reinforcing it are much better connected to one another. This increases its scope of application such that it is more economically applicable.

The loading part, the reinforcement section, the frame center section and the frame floor section may be made from plastic, especially an elastomer plastic, with a material such as polypropylene or polyethylene suitable for use. Parts made from such a plastic lend themselves readily to material-fit connections and are also hygienic and easy to clean, in comparison with pallets formed from wood. The aforementioned connections between the parts are of a material-fit type effected by a welding method, with hot-plate welding especially suitable. Hot-plate welding is one of those heating element welding methods in which heating elements heat the contact area to be welded until the material in the areas concerned softens, and then the heating elements are removed from the heated area. The components to be welded are then positioned against each other and aligned with each other under compressive force. Material in the area to be welded deforms fluidly and, in flowing, creates the material connection. Preferably, heating is performed not as far as the melting point of the plastic, but only to above the softening point.

For the purpose of supporting the welding process, at least a first welding rib is molded on to the spacers at the end face, said rib pointing toward the reinforcement section and serving as welding material during welding of the frame center section to the reinforcement section. The first welding rib of the spacer is advantageously closely molded on at a peripheral outside edge of the spacer and points upward and away from the frame center section. The rigidity of the connection is increased by the outer welding rib.

Further, at least a second welding rib is molded on at the end face of the elevations, said rib pointing toward the reinforcement section and serving as welding material during welding of the frame center section and the reinforcement section. The first and second welding ribs both have the same alignment, which is parallel to the loading surface. Thus, the welding planes defined by the first and second welding ribs are accordingly parallel to the loading surface. The second welding rib is thereby arranged closer to the loading surface than the first welding rib. Due to this vertical offset, correspondingly offset welding regions are produced, which, through their different positioning, serve to improve retention of the elevations in the recesses. Furthermore, the lateral gap between the elevation and the recess may be dimensioned such that a part of the material of the second welding rib flows into this area in order to yield a weld at a side that is not the end face of the elevation.

In a development in the area of the recesses at the reinforcement section, at least a third welding rib for welding the frame center section to the reinforcement section is provided. This third welding rib is multipart, i.e. formed from multiple parts. These third welding ribs are either formed as a rib-like elevations, or alternatively as incremental elevations. These third welding ribs are formed such that, during uniting of the reinforcement section and the frame center section, they press against the softened material of the second welding rib, and so flow of the material around the welding ribs is made possible. A good welded joint can be achieved by this flow around the third welding ribs. The material of the recess and thus the third welding rib may also be heated, with the material able to connect well to the material of the second welding rib and the elevations. A corresponding welding process is provided for welding of the first welding rib to the reinforcement section, as well for the other aforementioned material-fit connections.

The loading part may have an essentially flat surface at the upper surface and generally has the shape of a flat slab, such that the loading part can be cut out from an extruded flat slab. Since the material becomes thermoplastic during the extrusion process, clearly better values for strength are attainable than is the case for an injection molded material under given comparable material thicknesses. Thus, the loading surface, which corresponds to the surface of the loading part, has good mechanical properties, such that it is not damaged by transport goods that are placed on the loading surface.

The reinforcement section is arranged underneath the loading part. It is essentially tub-shaped and has a tub floor, with the open side of the tub limited by the loading part. The depth of the tub, that is, the distance in the vertical direction, is a few centimeters and the tub floor forms a plane that is parallel to the loading part. At the reinforcement section in the area of the tub floor, a plurality of rib-like elevations are molded on, which point toward the loading part and are in contact with it. Furthermore, the recesses at an area of the tub floor are molded on such that the vertical ends of the recesses are in contact with the loading part. In this regard, the reinforcement section may be designed such that it is manufacturable in a thermoforming process. In the thermoforming process, starting from a plastic slab, the three-dimensional structure is created, which substantially effects the stability of the upper section. Optionally, the reinforcement section has a material-fit connection at the aforementioned contact areas with the loading part. By means of reinforcement section ribs, connections from the loading part to the reinforcement section at a plurality of points or areas are produced, which provides a three-dimensional structure, which effects high strength for the upper section of the pallet. The reinforcement section ribs, which are located between two recesses, are aligned such that they point in the longitudinal direction from one recess to the next.

The upper section may have a plurality of handle openings. Expediently, the connection from the loading part to the reinforcement section in the area of the handle openings is a material-fit connection. To prevent workers from hurting their hands when handling the pallet, it is preferable that the handle openings arranged in the upper section are rounded.

At the pallet, an outwardly sealed transponder cavity may be provided for accommodating a transponder in the area of the spacers. Furthermore, at an exterior surface of the transponder cavity, the wall thickness of the pallet is at least locally reduced. The transponder cavity is outwardly sealed in order that no harmful environmental influences, such as damp, may penetrate and damage the electronics of the transponder. Further, at an exterior side of the transponder cavity is provided an area of smaller wall thickness, which may correspond to the lower surface of the pallet, such that, for example, the material there can be removed with a knife in order that an opening may be created through which the transponder can be replaced. A replacement of this kind may be necessary if, due to technical changes, for example, new transponders or altered specifications, a transponder, which was already inserted into the transponder cavity during production of the pallet, can no longer be used. If a transponder is replaced via the window in the frame floor section, the transponder cavity can be sealed by a plastic molding compound in order that the replaced transponder may be protected from environmental influences.

Optionally, the reinforcement section in the area of its side wall has an impact reinforcement, areas of which at least are formed so as to be corrugated or ribbed. The impact reinforcement may lead, starting from the floor surface of the tub-shaped form of the reinforcement section, upwardly to as far as the edges of the reinforcement section that are in contact with the loading part. The corrugations lie in a plane that is parallel to the loading surface. The shape of the impact reinforcement ensures that the impact strength is increased, a fact which is helpful if the pallet experiences jerky lateral loads, for example, during transport or when grabbed by the tines of a fork-lift truck or a lifting truck.

Furthermore, handle recesses may be provided at the reinforcement section. These are expediently arranged at the reinforcement section in the area of the transport openings, such that they are arranged at a slight distance from the side wall at which the impact reinforcement is molded on. The handle recesses comprise an indentation, which is at least as wide as a human hand.

Optionally, the reinforcement section has an anti-slipping rim that projects over the upper surface of the loading part and serves to limit slipping of goods present on the loading surface. The bulk of the reinforcement section is underneath the loading part in the vertical direction. However, some bar-like areas of the reinforcement section may be molded on such that they terminate above the loading part at the sides. Thus, for example, an interrupted bar which has a uniform height of, for example, 1 cm, can be created at the outside edge of the loading surface. Goods might slip on the loading area due to transport forces, but this slippage is limited by the anti-slipping rim. Advantageous in this regard is that the anti-slipping rim is easily producible, does not require a separate part and also lends itself to better stacking of several pallets. It is advantageous that the anti-slipping rim is formed as a component of the reinforcement section, since as such it is more readily and economically producible, a fact which would not be obtained if it were a component of the loading part, which may be manufactured by extrusion.

For the purpose of easy stacking of several pallets one above the other, corresponding anti-slipping rim recipients are molded on at the frame floor section, in which the anti-slipping rim of a further pallet may be accommodated. This offers advantages in the stacking of several pallets since alignment and immobilization of pallets lying one on top of the other is achieved.

The pallet may have four bar-like carriers in which stiffening profiles are arranged. These carriers form the framework of the frame section. The frame section may have four large-area rectangular floor break-throughs. In the bar-like areas, which limit the floor break-throughs, stiffening profiles can preferably be arranged. These recipient areas for the stiffening profiles are located in the area of the contact surface of the frame center section and frame floor section.

These stiffening profiles can be rectangular or square hollow sections made from a metal, especially steel, and serve to increase the torsional rigidity of the pallet. A plastic profile resistant to bending is also conceivable.

Optionally, the stiffening profiles are provided in the frame of the frame section described by the external form of the pallet, with one profile provided per edge. A further profile can be provided in one of the edges of the central crosspiece of the frame section, as a result of which therefore four or five stiffening profiles result. The stiffening profiles can be economically inserted as individual parts into the frame sections independently of each other. They can, however, also be welded to one another, which further increases the rigidity. To increase the number of industrial applications for which the pallet may be used, the pallet is formed from a fire retardant material. The fire retardant material may comprise a polymer or plastic or resin material that includes a fire retardant additive. A pallet formed from such a fire retardant material may inhibit a fire if the pallet is positioned in the vicinity of the fire. Thus, if a part of a warehouse containing the pallets is set on fire, the flame-retarding material may cause the fire to be generally inhibited, such that it spreads more slowly and is easier to extinguish. Thus, the pallet is highly suitable for use in areas that are at risk of fires and for transporting readily flammable materials.

Thus, the pallet described herein is developed for pallet pooling or circulating activities, or pallet rental activities and is therefore reusable and heavy duty. The pallet is adapted for use in combination with cardboard boxes, food or beverage crates, automotive crates or any other type of uniform distributed load which is used in a pooling environment. Additionally, the pallet may be formed from a fire retardant material, which may comprise a polymer, plastic or resin having a fire retardant additive.

The following drawings show the preferable embodiment, without limiting the inventive idea expressed in the claims. These and other objects, advantages, purposes and features of the present invention will become apparent upon review of the following specification in conjunction with the drawings.

DETAILED DESCRIPTION OF THE DRAWINGS

Figure 1:
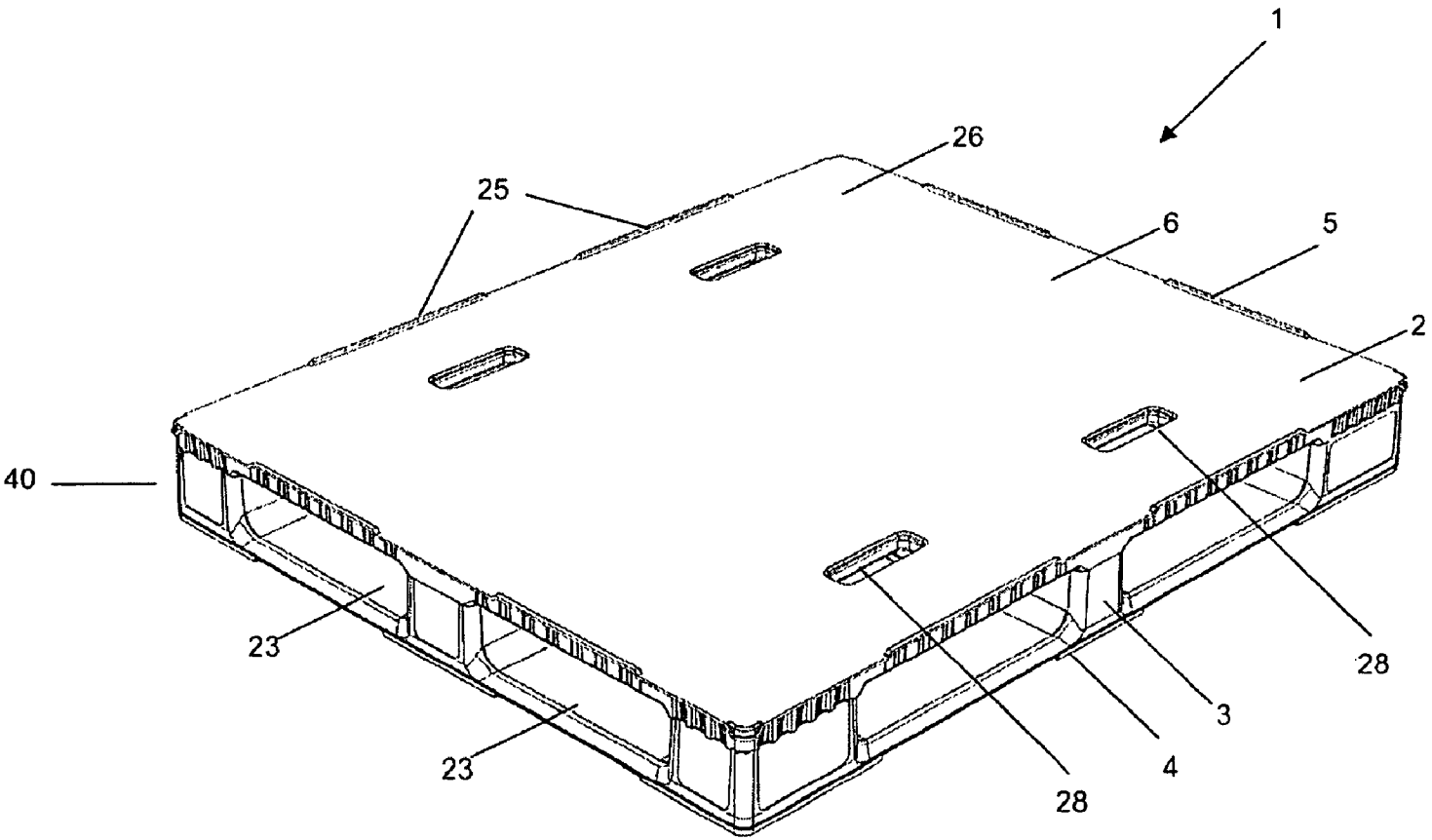
FIG. 1 is a three-dimensional view of the pallet in the position of normal use, wherein the loading surface points upward.

Referring now to the drawings and the embodiments illustrated therein, FIG. 1 is a three-dimensional view of a pallet in accordance with the invention, whose loading surface 26 points upward. In the following, it is this definition of the direction which is referred to. The loading surface 26 is an area of the loading part 6, which, together with the reinforcement section 5, forms the upper section 2 of the pallet 1. Underneath the upper section 2 is arranged the frame section 40, which comprises the frame center section 3 and the frame floor section 4. The frame section 40 has a rectangular basic structure, which corresponds roughly in size to the loading surface 26, and in this basic structure are provided four wide, window-like break-throughs, such that the frame section 40 has essentially four external struts and a central crosspiece 42, as evident in FIG. 2. Underneath the frame center section 3 is the frame floor section 4, which is connected to the frame center section 3 and has a platform for the surface. Stiffening profiles 7*a*, 7*b* are accommodated in the area between frame center section 3 and frame floor section 4.

Upper section 2 has four handle openings 28, which are long enough and wide enough for a worker to put in a hand to comfortably lift the unloaded pallet. The alignment of the handle openings 28 in their length corresponds to the longitudinal direction of the rectangular pallet 1. The handle openings are arranged at the edge of the upper section 2. Alternately, the pallets may be transported using either a hand pallet truck or a fork lift truck. The pallet may include a cruciform bottom deck, which is designed for four-way entry by a fork lift or hand pallet truck. The pallet may also include chamfered skids for easy access by such a truck. Further, the top deck of the pallet may include anti-slipping rims 25 which prevent sliding or shifting of the load from the pallet during transport.

Figure 2:
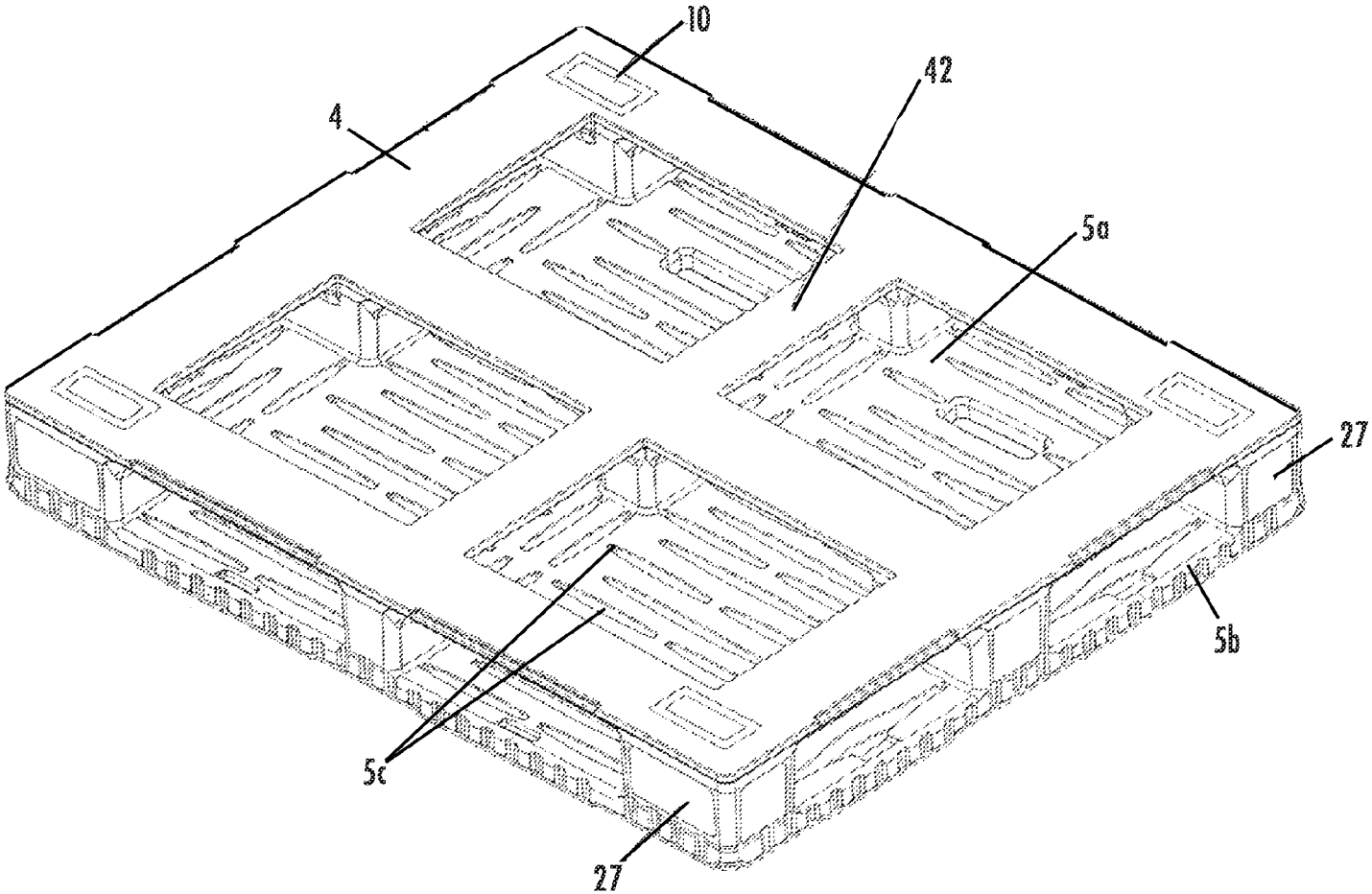
FIG. 2 is a corresponding three-dimensional lower view of the pallet.
Figure 2A:
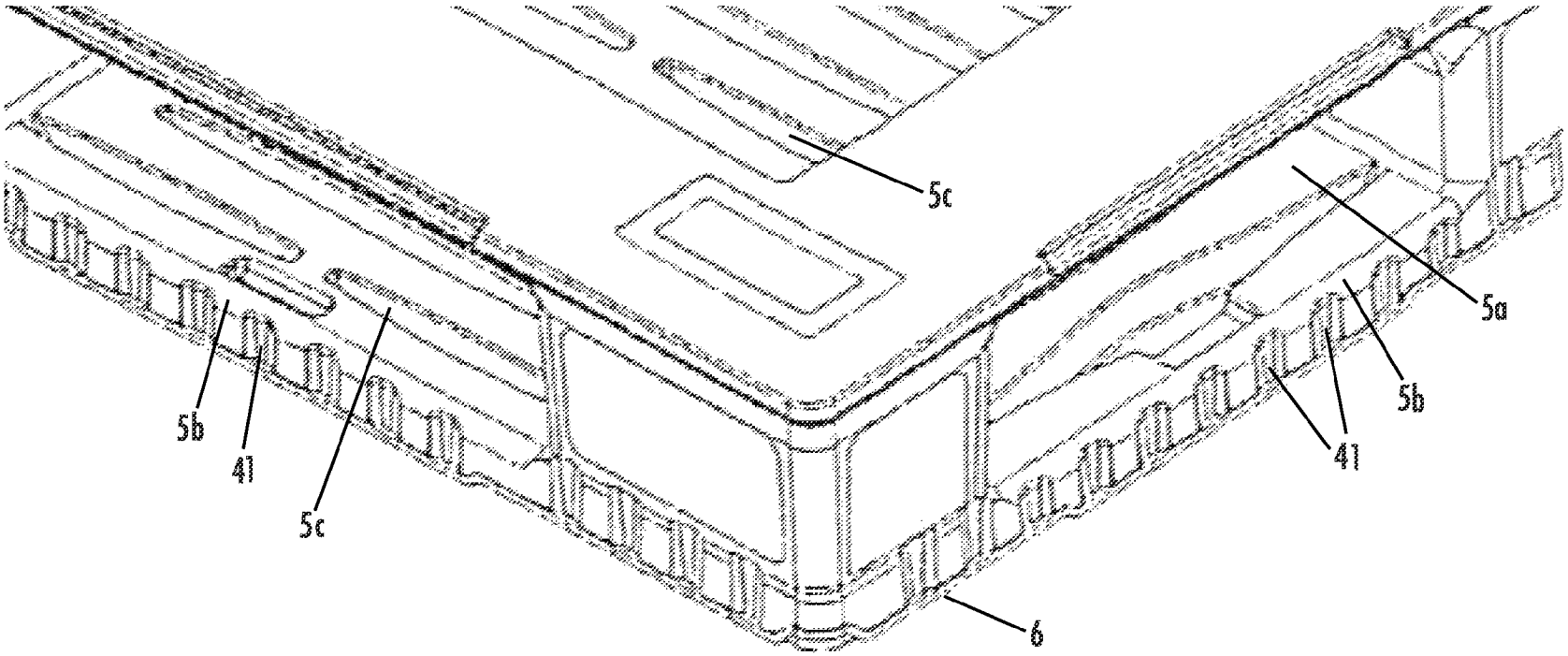
FIG. 2A is an enlarged fragmentary perspective taken from FIG. 2.
Figure 2B:
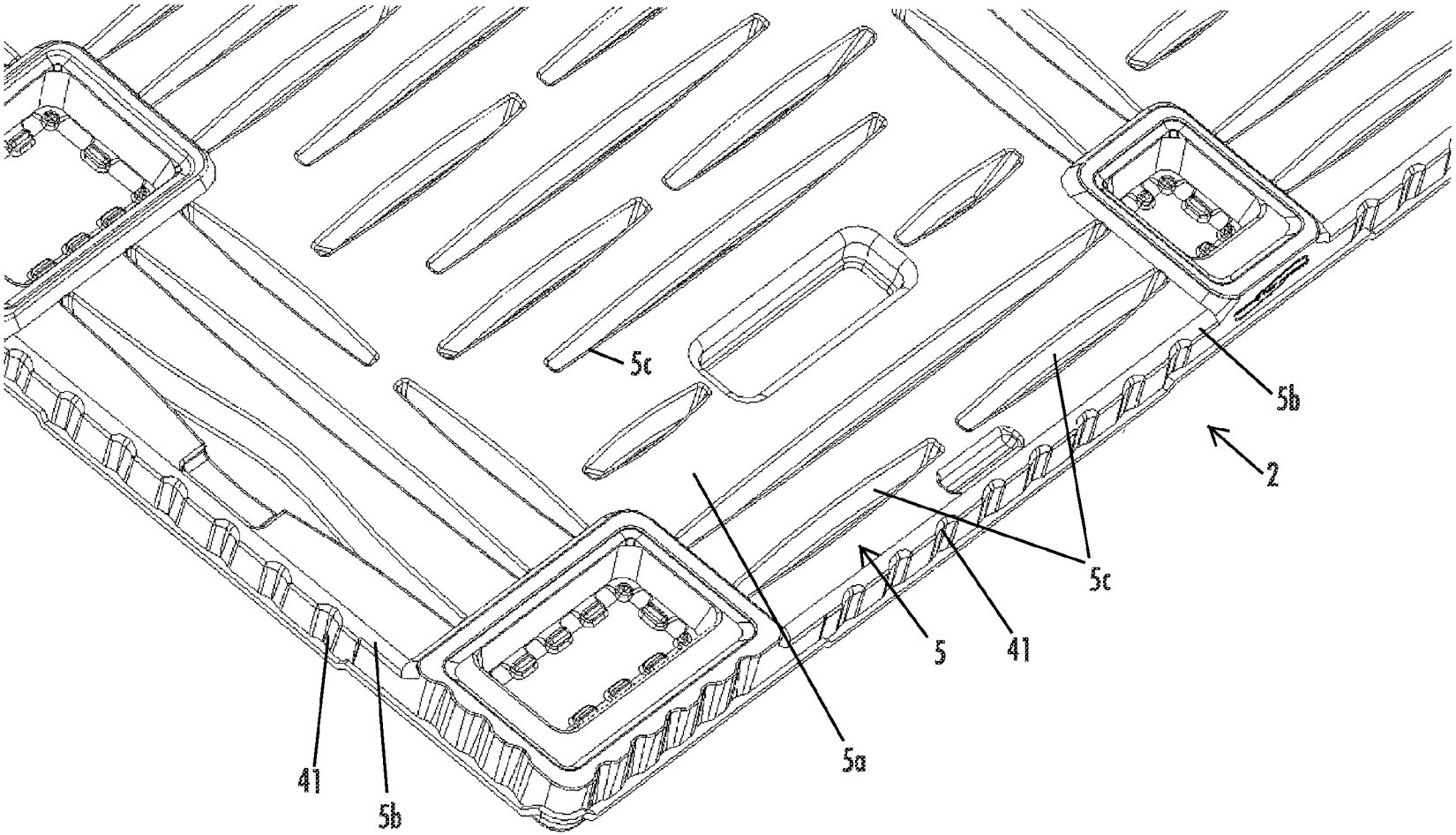
FIG. 2B is an enlarged fragmentary perspective bottom view of the upper part of the pallet.
Figure 3:
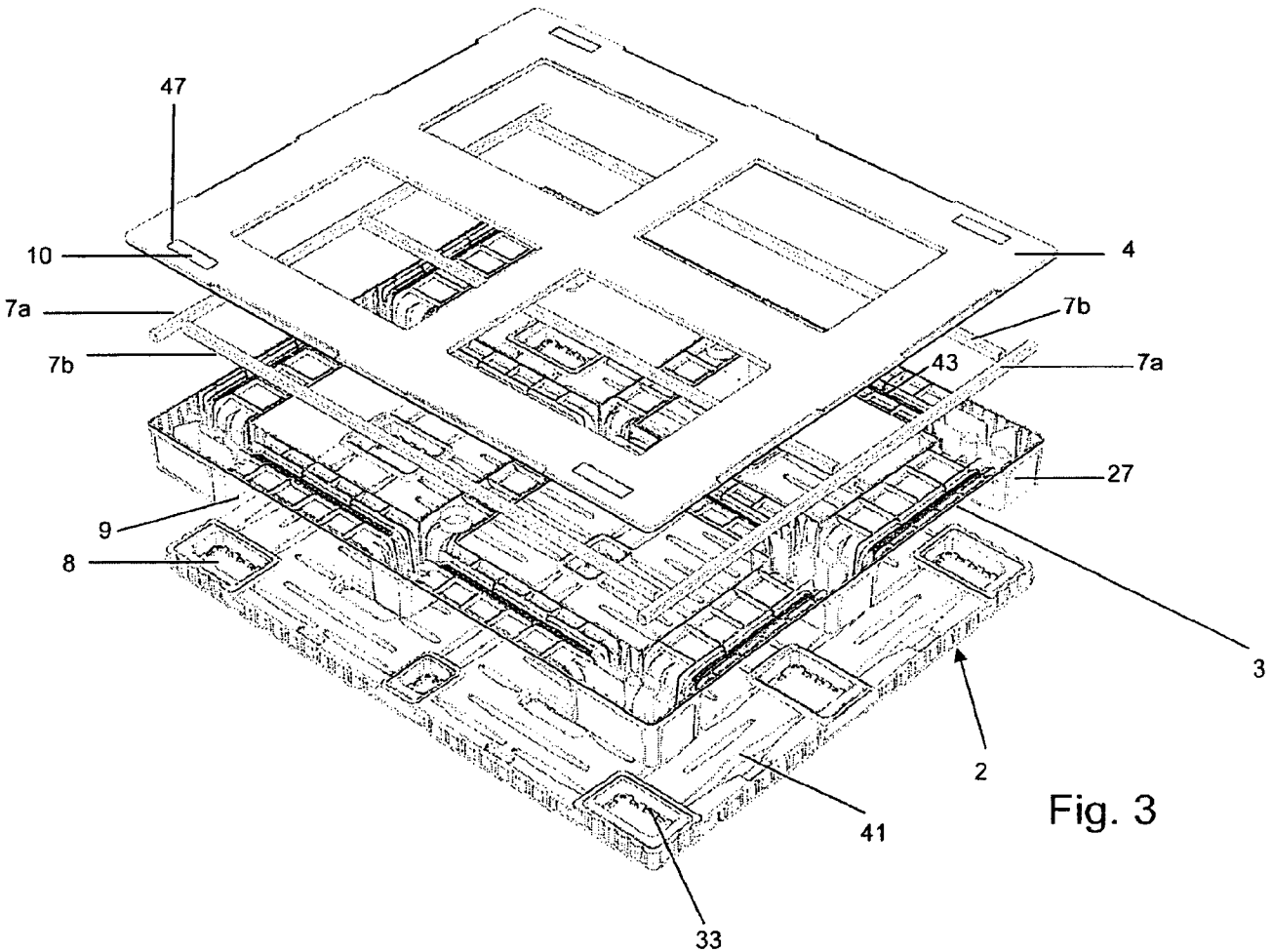
FIG. 3 is a partly exploded view of the pallet, in which the reinforcement piece and loading part are not exploded toward each other.

As is evident from FIG. 3, the upper section 2 is of uniform thickness, which is created by the distance from the loading part 6 to a parallel arranged base surface 5*a* (FIGS. 2, 2A, and 2B) of the reinforcement section 5. To increase the stiffness and decrease the weight of the pallet, upper section 2 may be formed from two sheets or twin sheets of material, as opposed to being a solid section. At the sides of this base surface are provided essentially perpendicularly arranged edges or side walls 5*b* (FIGS. 2, 2A, and 2B), which form a perimeter wall that points toward the loading part 6 and is connected to this. Viewed in this way, the reinforcement section 5 has a tub-shaped basic structure, with the open side of the tub limited by the loading part 6. At the outer peripheral contact area between reinforcement section 5 and the loading part 6 are provided areas upon which the loading part 6 on the reinforcement section 5 rests. In other words, the contact surface here is horizontally aligned such that gravity forces from goods present on the loading part 6 are transmitted direct via compressive forces to reinforcement section 5. These areas are arranged at the corners of the pallet and at the center of their sides. On areas located between them are arranged anti-slipping rims 25, which are a component of the reinforcement section 5, arranged such that they terminate above the loading area 26. The contact surface between the reinforcement section 5 and the loading part 6 has a vertical alignment there. The loading surface 26 is limited at each of its sides by two anti-slipping rims 25. Additionally, reinforcement ribs 41 (see FIGS. 2, 2A, and 2B), provide a plurality of points or areas for connection between the loading part and the reinforcement section, which provides a three-dimensional structure, which effects high strength for the upper part. Furthermore, the recessed portions 5*c* in the area of the tub floor (base surface 5*a*) are molded to formed recesses in the base surface such that the vertical ends or upper ends of the recessed portions are in contact with the loading part 6.

In FIG. 3, it is clear that the reinforcement section 5 comprises a plurality of reinforcement section ribs 41 (see FIGS. 2, 2A, and 2B), which, starting from the base surface of the reinforcement section 5, point toward to the loading part 6, have a longitudinal extension and are in contact with the loading part 6. At the contact areas between the loading part 6 and the reinforcement section 5 is provided a material-fit connection, a fact which means that the material of both parts is welded in these areas. Through the welds, the loading part 6 and the reinforcement section 5 enclose an area, which is designed to be dampproof.

The reinforcement section offers the pallet great stability when stacked, without damaging the load. Additionally, the reinforcement section may be at least partially formed from steel and may increase the load capacity of the pallet. For example, a pallet in accordance with the present invention is adapted for supporting a flat static load up to 30,000 pounds, a flat dynamic load up to 5,000 pounds or a flat racking load up to 2,800 pounds. A pallet having this load capacity may be generally rectangular and may have external dimensions of a length of approximately 48 inches, a width of approximately 40 inches and a height of approximately 5-6 inches. Such a pallet may have a weight of approximately of 48-49 pounds.

Figures 6, 7, 8, 9, 10, 11, 12:
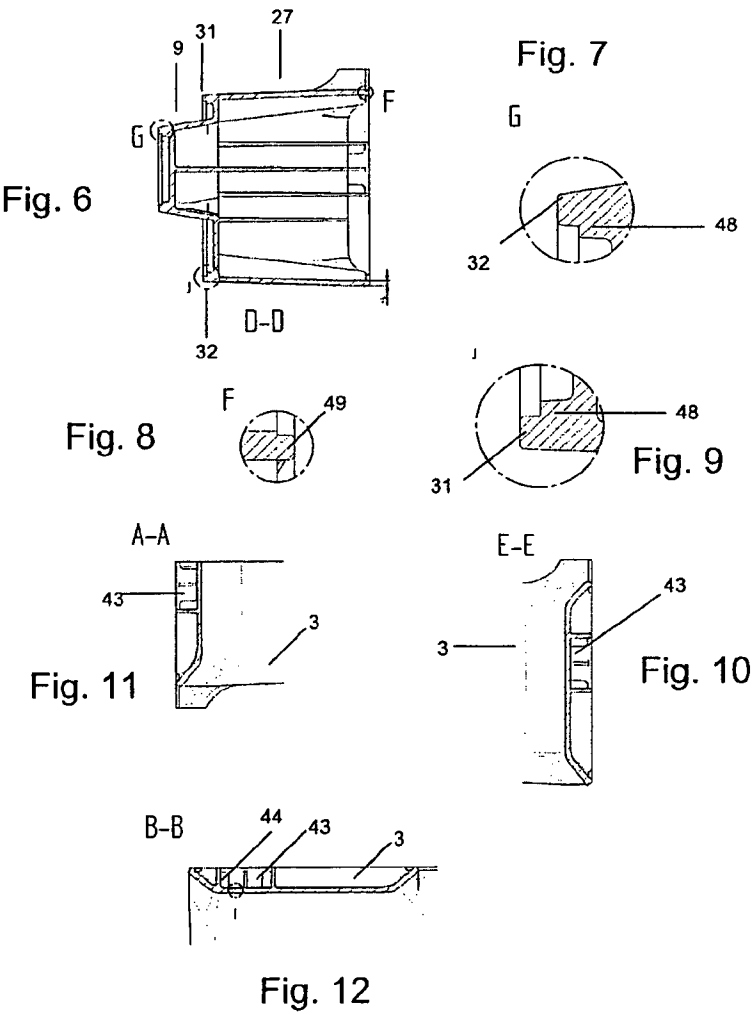
FIG. 6 is a cross-sectional view on the line D-D of FIG. 5 through one of the elevations 9.
FIG. 7 is a detailed view of FIG. 6 with the representation of the second welding ribs.
FIG. 8 is a detailed view of FIG. 6 of the welding ribs for welding of frame center section to the frame floor part.
FIG. 9 is a detailed view of the FIG. 6 of the first welding ribs.
FIG. 10 is a cross-sectional view on the line E-E of FIG. 5.
FIG. 11 is a cross-sectional view on the line A-A of FIG. 5.
FIG. 12 is a cross-sectional view on the line B-B of FIG. 5.
Figure 18:
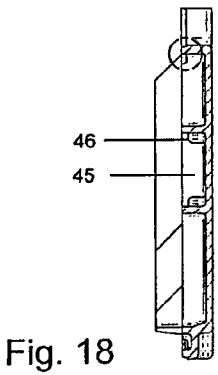
FIG. 18 is a cross-sectional view on the line B-B of FIG. 15.
Figure 20:
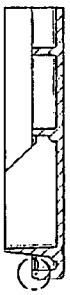
FIG. 20 is a cross-sectional view on the line E-E of FIG. 15.

The view of the lower side of the pallet in FIG. 2 clearly shows the central crosspiece 42 of the frame section 40. It extends centrally in the frame, which is spanned by the four corners of the pallet 1. The central crosspiece 42 as well as the lower area of the frame section 40 are formed from the frame center section 3 and the frame floor section 4. As FIG. 3 shows, in areas between the frame floor section 4 and the frame center section of 3 are arranged two stiffening profiles 7*a* and three stiffening profiles 7*b*, with two each of the profiles 7*a* and 7*b* in the outside edges of the framework and a profile 7*b* in an axis of the central crosspiece 42. The stiffening profiles 7*a* and 7*b* are manufactured from a rectangular steel section. At the lower side at the frame center section 3 are provided center section profile recipients 43, which are U-shaped. As shown in FIGS. 10, 11 and 12, center section profile recipients 43 are roughly the width of the stiffening profiles 7*a* or 7*b* and half their height. Each of the stiffening profiles 7*a* and 7*b* is fitted into the profile recipient 43 such that approximately half of the height projects above the center section profile recipient 43 and is accommodated in a profile recipient 45—see FIG. 18—of the frame floor section 4. Furthermore, for the purpose of lateral guidance of the stiffening profiles 7*a*, 7*b*, ribs 46 are molded on at the frame center section ribs 44 and at the frame floor section, said ribs 46 limiting the lateral mobility of the profiles. Since the ribs 44 deform flexibly when the stiffening profiles 7*a* and 7*b* are joined to the frame center and floor sections, the stiffening profiles are accommodated without any play and so can easily accommodate twisting of the pallet and thus support the rigidity of the pallet. Additionally, the frame center and floor sections are aligned relative to each other via the stiffening profiles 7*a* and 7*b* during joining in the production process.

Figure 4:
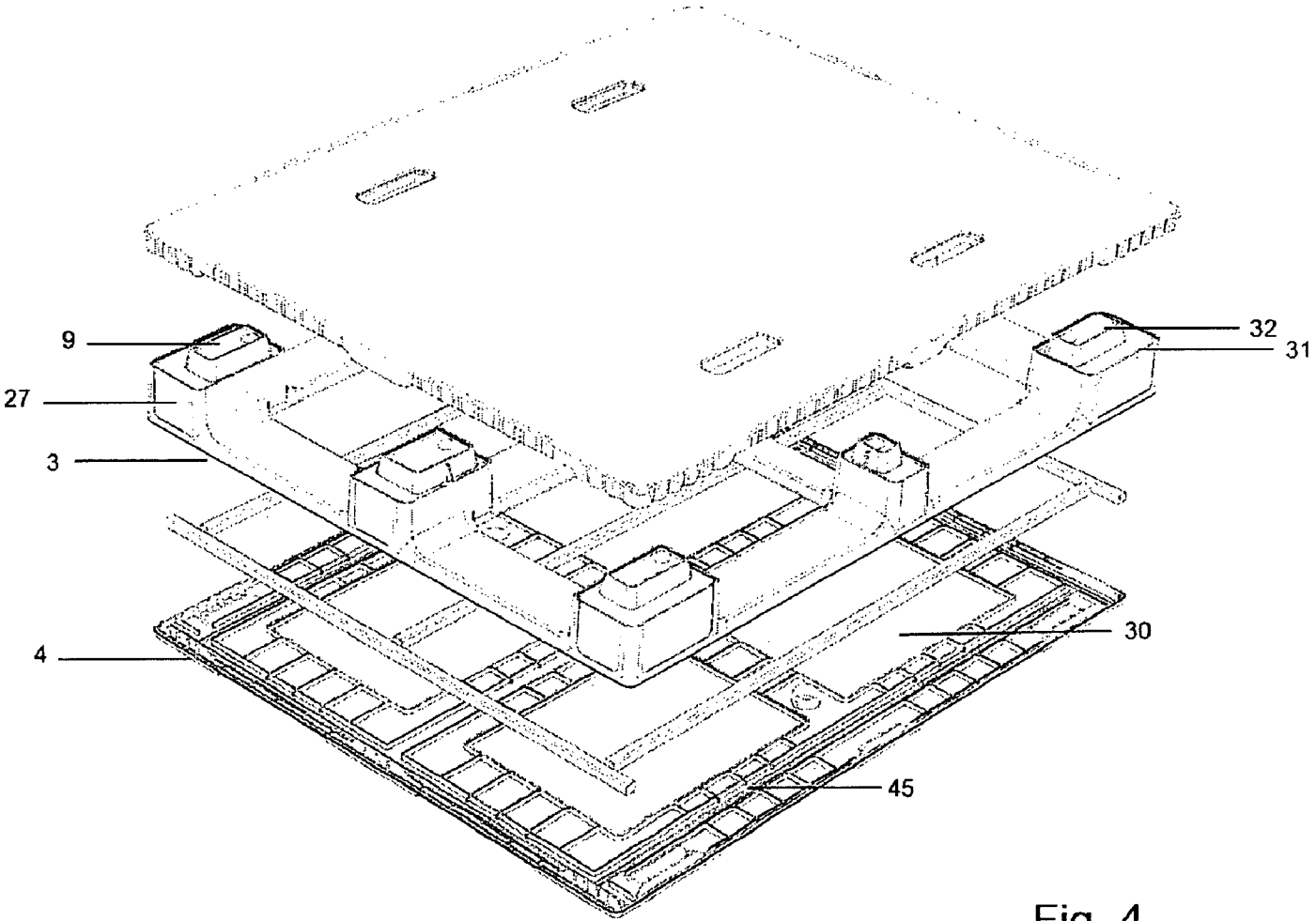
FIG. 4 is a rotated view of the exploded view in accordance with FIG. 3.

At the frame center section 3 are molded on nine spacers 27, which contact its four corners, four centers of its outside edges and the center of its surface. As evident from FIG. 4 or FIG. 6, provided at the spacers 27 are elevations 9, which are present at an end face of the spacers and are inwardly offset stepwise. Both the spacers 27 and the elevations 9 are essentially rectangular, with the length and width of the elevations 9 smaller than those of the spacers 27. FIG. 6 shows that the elevation 9 has a truncated pyramid extension. Reinforcement piece 5 has corresponding recesses 8, in which the elevations 9 are accommodated. Here, the truncated pyramid shape facilitates joining of the frame center section to the reinforcement section in the manufacturing process, since both parts position themselves relative to each other via the diagonal edge.

FIG. 4 or 6 shows how first welding ribs 31 are molded on at the spacer 27, and second welding ribs 32 are molded on at the end of the elevation 9. Both, the first and second welding ribs, are each molded on at the end-face outside edges of the spacer 27 and the elevations 9. During welding of frame center section 3 to the upper section 2, the ribs 31 and 32 are heated to the softening point, then the two parts are joined to each other. During joining, mechanical pressure is exerted on the first and second welding ribs 31 and 32, such that these ribs deform fluidly, such that this flow creates a material-fit connection between the two parts. This process is supported by third welding ribs 33, which are shown in FIG. 3. The third welding ribs 33 are at the base of the recesses 8 and make contact with the second welding ribs 32 during joining. Since the third welding ribs 33, unlike the second welding ribs 32, are not formed continually around the periphery, but project from area to area, the material of the second welding ribs 32 can flow around the third welding ribs 33 during joining, whereby the strength of the welded joint can be improved.

Figure 5:
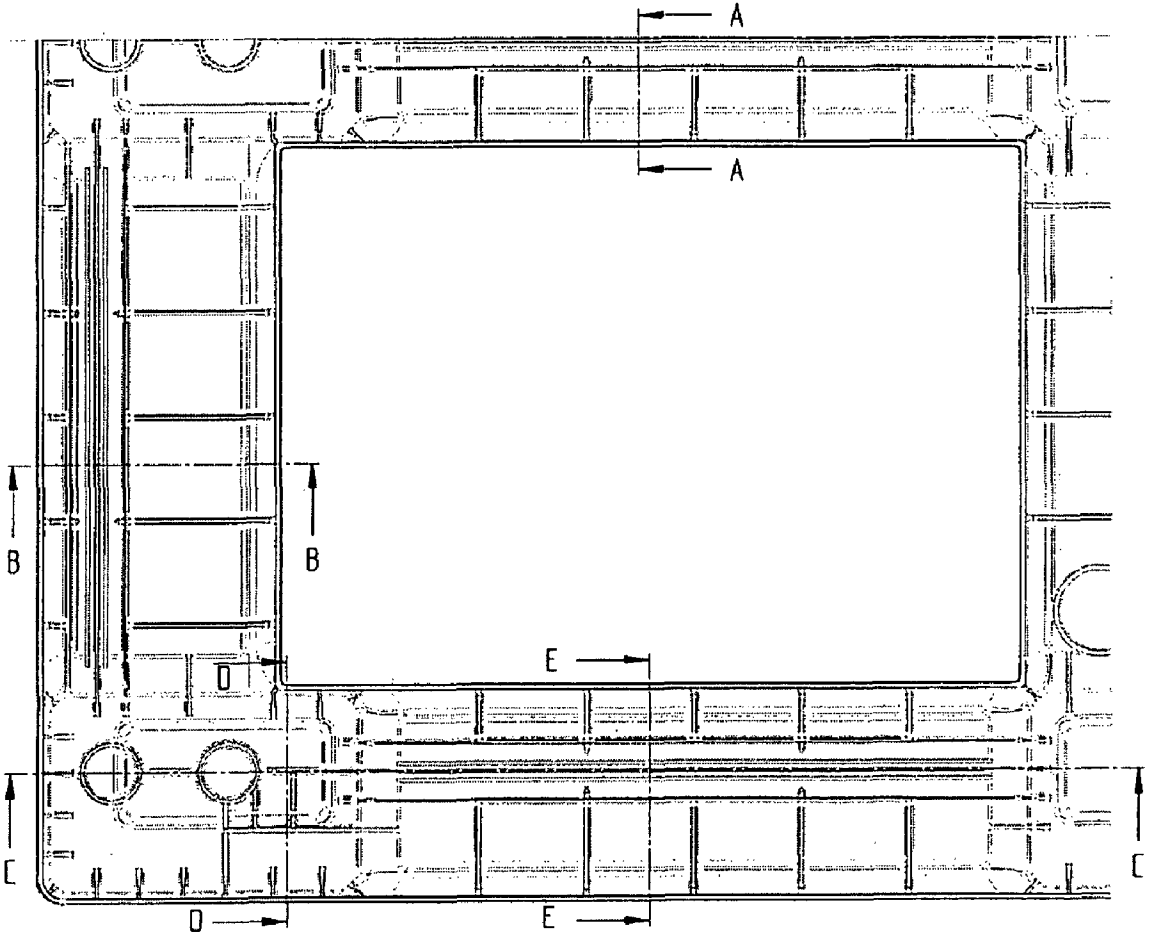
FIG. 5 is a plan view of a quarter of the frame center section, with the lower right corner shown.

FIG. 5 shows a plan view of the lower right corner of the frame center section 3, which shows only one of the four windows of the frame center section 3. In the lower right corner of FIG. 5 is shown a plan view 5 of the spacer 27, which, in cross-sections along lines D-D, in accordance with FIG. 6, and C-C, in accordance with FIG. 5, is shown in detail in both side views.

FIGS. 7 and 9 show the shape of the welding ribs 32 and 31 in details G and J. At those areas where the ribs at the elevation 9 or the spacer 27 are molded on is provided one each of a material accumulation 48, which has a larger wall thickness than the corresponding welding rib 31 and 32. In the welding method, temperature control ensures that primarily the material of the welding ribs is softened. Since, in the area of the material accumulation 48, the heat supplied is insufficient to soften the material, during welding, this area, and thus also elevations 9 and the spacers 27, remain undeformed as far as possible and material softening is limited to the welding ribs.

In FIG. 8, a fourth welding rib 49 of the frame center section 3 is shown, which serves for welding to the frame floor section 4. Peripheral fourth welding ribs 49 are each arranged around one of the window-like break-throughs, such that the frame center section 3 and the frame floor section 4 at these welding seams can be connected to each other continuously and thus to be impermeable to damp.

Figure 13:
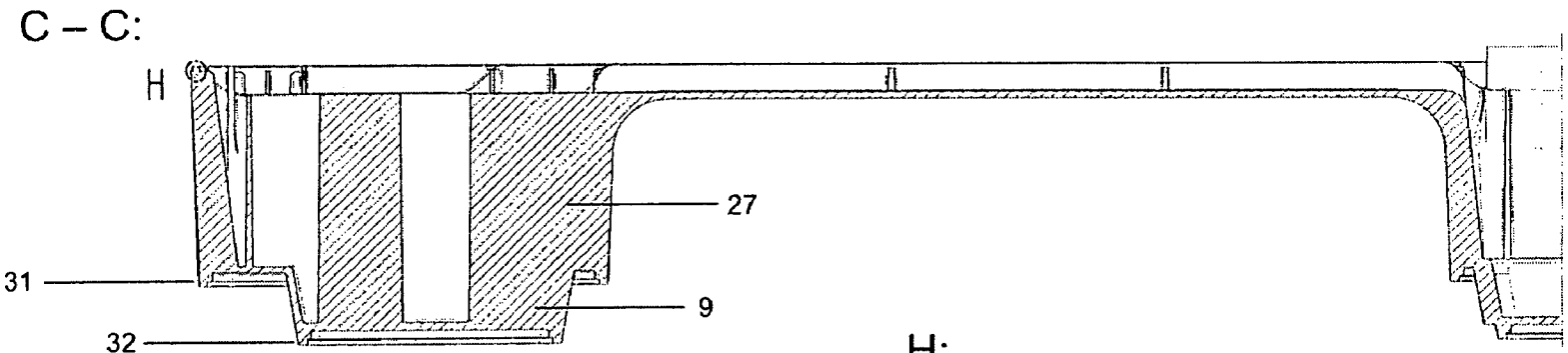
FIG. 13 is a cross-sectional view on the line C-C of FIG. 5.
Figure 14:
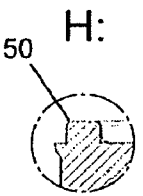
FIG. 14 is a detailed view of FIG. 13 of the welding ribs for welding the frame center section to the frame floor section.

FIGS. 11 and 12 show the cross-sections along lines A-A and B-B of FIG. 5 with a part of the frame of the frame section 40, the center section profile recipients 43 and corresponding ribs 44, which serve the purpose of guidance of the ribs shown. FIG. 13 shows a section through the frame center section 3, whose detail H in FIG. 14 shows a fourth welding rib 50. This is arranged peripherally at the outside edge of the frame center section 3 and makes for a dampproof weld to the frame floor section 4 in this area.

Figure 15:
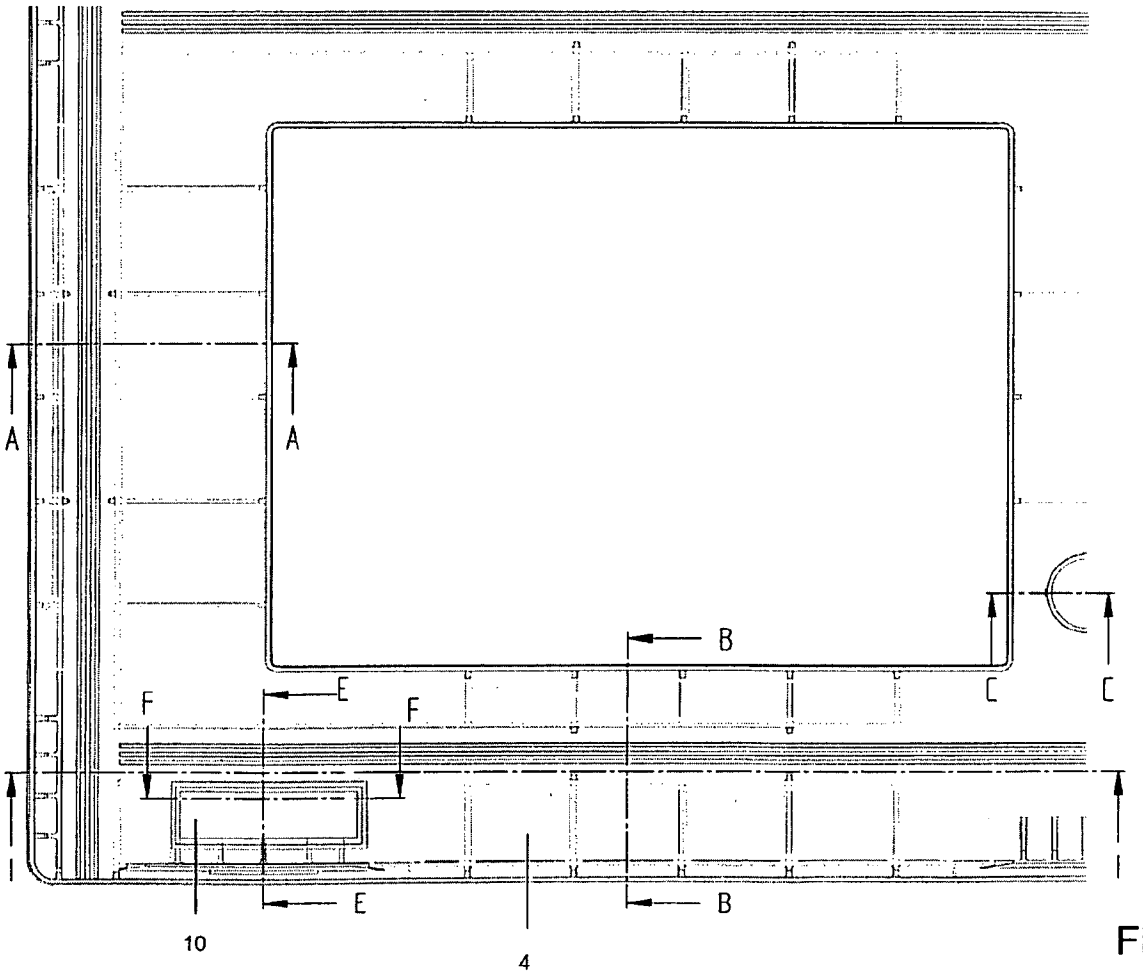
FIG. 15 is a plan view of a quarter of the frame center section, with the lower right corner shown.
Figure 16:
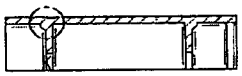
FIG. 16 is a cross-sectional view on the line F-F of FIG. 15.
Figure 17:
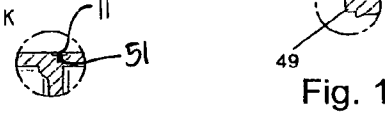
FIG. 17 is a detailed view of FIG. 16.
Figure 19:
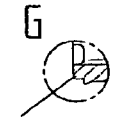
FIG. 19 is a detailed view of detail G of FIG. 20.

FIG. 15 shows a plan view of the lower right quarter of the frame floor section 4, and the section in accordance with FIG. 16 with the detail K in accordance with FIG. 17 shows a groove 47, which is molded on at the lower surface of the frame floor section 4. This groove 47 is rectangular, as shown in FIG. 3, and forms an area in which the wall thickness of the frame floor section 4 is reduced. This groove 47 thus delimits in other words a window 10, behind which extends toward the spacer 27 an inner space as transponder cavity 11, which is suitable for accommodating a transponder. Before the frame center section 3 is welded to the floor section 4, a transponder 51 is inserted into this transponder cavity 11, said transponder being then enclosed by welding so as to be dampproof. Only when, for example, a cut is made with a knife along the groove 47, is the window 10 opened, such that access to the inserted transponder is made possible. In this way, the transponder can be removed and replaced, for example. Then, plastic, such as a plastic foaming compound, can be used to seal the window again in order that harmful environmental influences may be kept at bay from the transponder. At each of the spacers 27, which lie at the corners of the pallet, is provided a transponder cavity.

Transponder 51, which is also known in the art as an RFID or RFID tag (radio-frequency identification), may be used as part of a wireless tracking and tracing system for locating, localizing and circulating or distributing the pallets. Transport pallets of the type disclosed herein may be used in pooling or rental systems, wherein the pallets are temporarily used by a customers and returned when the pallets are no longer needed. However, customers may lose track of the pallets in their possession. To ensure that pallets do not become lost or remain out of use for a significant period of time, a provider or service company which provides and circulates the pallets may use the transponder to determine the position and location of each pallet. Thus, the company supplying the pallets has access to the location of its entire supply chain of pallets, and can determine each of its customer's inventory of pallets. It can also be determined, based on the tracking data, whether the pallets are in use, i.e. being used to transport goods. If the transponders show that a customer has pallets that have remained stationary and that appear to be out of use, the pallets may be returned from the customer to the service company, cleaned, and again introduced into the transport process, and shipped to another customer in need of transport pallets.

To increase the number of industrial applications for which the pallet may be used, the pallet described herein may be formed from a fire retardant material. The fire retardant material may comprise a polymer or plastic or resin material, such as ethylene vinyl acetate, which may include a fire retardant additive. For example, the fire retardant additive may comprise a brominated flame retardant and/or an antimony trioxide synergist. Because the additives are encapsulated in a neutral polymer, they are not considered hazardous in this application and are acceptable for use in the production of packaging materials, including transport pallets in accordance with the present invention.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A pallet for the movement of goods, comprising:

an upper section having a loading part with a loading surface and a reinforcement section, wherein the loading surface and the reinforcement section have a material-fit connection to each other;

a frame section comprising a frame center section and a frame floor section, wherein the frame center section and the frame floor section are connected to each other;

wherein the frame center section corresponds to the size of the loading surface and, at least at its corners, has spacers which point to the upper section and have a material-fit connection via the frame section to the upper section, wherein the spacers have end-face elevations inwardly offset stepwise, and the reinforcement section has, at its lower surface, recesses for accommodating the elevations;

wherein the frame center section has a material-fit connection to the reinforcement section in the area of at least one of the spacers and the end-face elevations wherein the reinforcement section comprises an inverse tub-shaped section with a base surface and perpendicular perimeter wall extending around said base surface and projecting downwardly from the base surface, and said base surface being spaced from said loading part and arranged parallel to the loading part; and said perimeter wall having four side walls, each of said side walls including a plurality of ribs extending to and contacting the loading part to thereby reinforce the loading part.

2. The pallet in accordance with claim 1, wherein the loading part, the reinforcement section, the frame center section and the frame floor section are formed from one of a plastic, a polymer and a resin.

3. The pallet in accordance with claim 2, wherein said pallet is formed from a fire retardant material.

4. The pallet in accordance with claim 2, wherein said one of a plastic, a polymer and a resin includes a fire retardant additive.

5. The pallet in accordance with claim 4, wherein at least a first welding rib is molded to the end faces of the spacers , wherein the at least one welding rib points toward the reinforcement section and serves as welding material during welding of the frame center section to the reinforcement section.

6. The pallet in accordance with claim 5, wherein at least a second welding rib is molded to the end faces of the elevations, wherein the at least one welding rib points toward the reinforcement section and serves as welding material during welding of the frame center section to the reinforcement section.

7. The pallet in accordance with claim 6 wherein at least a third welding rib is provided at the reinforcement section in the area of the recesses for welding the frame center section to the reinforcement section.

8. The pallet in accordance with claim 7, wherein the third welding rib is comprised of multiple parts.

9. The pallet in accordance with claim 4, wherein the reinforcement section is adapted to be produced in a thermoforming process.

10. The pallet in accordance with claim 4, wherein the upper surface of the loading part is planar.

11. The pallet in accordance with claim 4, wherein the reinforcement section has an impact reinforcement in the area of a side wall of the reinforcement section, wherein said reinforcement section is formed to be corrugated or rib-like at least from area to area.

12. The pallet in accordance with claim 4, wherein handle recesses are provided at the reinforcement section.

13. The pallet in accordance with claim 4, wherein the reinforcement section comprises at least one anti-slipping rim for limiting slipping of goods present on the loading surface, said rim projecting over the upper side of the loading part.

14. The pallet in accordance with claim 13, wherein at least one anti-slipping rim recess is formed in the frame floor section, wherein a further pallet may be received in the recess during stacking of the anti-slipping rim.

15. The pallet in accordance with claim 4, wherein the pallet comprises at least four stiffening profiles made of metal.

16. The pallet in accordance with claim 4, wherein the frame section has at least four bar-like carriers, wherein stiffening profiles are arranged in the bar-like carriers.

17. The pallet in accordance with claim 4, wherein the reinforcement section is producible in a thermoforming process.

18. The pallet in accordance with claim 4, wherein the upper surface of the loading part is planar.

19. The pallet in accordance with claim 4, wherein said base surface of the reinforcement section has a plurality of recessed portions forming recesses, each of the recessed portions having an upper end, the upper ends of the recessed portions contacting the loading part to thereby provide reinforcement to the loading part.

20. The pallet in accordance with claim 4, wherein said fire retardant additive comprises one of a brominated flame retardant and an antimony trioxide synergist.

21. The pallet in accordance with claim 20, wherein the reinforcement section is producible in a thermoforming process.

22. The pallet in accordance with claim 20, wherein the upper surface of the loading part is planar.

23. The pallet in accordance with claim 20, wherein said base surface of the reinforcement section has a plurality of recessed portions forming recesses, each of the recessed portions having an upper end, the upper ends of the recessed portions contacting the loading part to thereby provide reinforcement to the loading part.

24. The pallet in accordance with claim 1, wherein the upper section has a plurality of handle openings.

25. The pallet in accordance with claim 24, wherein the loading part and the reinforcement section have a material-fit connection in the area of the handle openings.

26. The pallet in accordance with claim 1, including a transponder for tracking the location of the pallet.

27. The pallet in accordance with claim 26, wherein an outwardly sealed transponder cavity is provided at the pallet in the area of the spacers for accommodating said transponder, wherein at an exterior surface of the transponder cavity, the wall thickness is reduced at least from area to area.

* * * * *